United States Patent [19]

Finch et al.

[11] Patent Number: 4,524,014

[45] Date of Patent: Jun. 18, 1985

[54] PHOTOBLEACH SYSTEM, COMPOSITION AND PROCESS

[75] Inventors: Timothy D. Finch, Wirral; Stuart W. Beavan, Birkenhead, both of England

[73] Assignee: Lever Brothers Company, New York, N.Y.

[21] Appl. No.: 467,545

[22] Filed: Feb. 17, 1983

[30] Foreign Application Priority Data

Feb. 19, 1982 [GB] United Kingdom ..... 8204959
Mar. 9, 1982 [GB] United Kingdom ..... 8206842

[51] Int. Cl.[3] ..... H07J 7/18; C11D 7/54

[52] U.S. Cl. ..... 252/188.1; 252/188.2; 252/188.21; 252/105; 252/107

[58] Field of Search ..... 252/188.1, 188.2, 188.21, 252/105; 8/107

[56] References Cited

U.S. PATENT DOCUMENTS 3,927,967 12/1975 Speakman ..... 8/107
4,033,718 7/1977 Holcombe et al. .
4,077,768 3/1978 Johnston et al. ..... 8/107
4,094,806 6/1978 Wiers ..... 8/107
4,166,718 9/1979 Reinert et al. ..... 8/107
4,217,105 8/1980 Goodman ..... 8/107
4,240,920 12/1980 de Luque .
4,318,883 3/1982 Polony et al. .
4,400,173 8/1983 Beavan ..... 8/107

FOREIGN PATENT DOCUMENTS 3149 7/1979 European Pat. Off. .
0003371 8/1979 European Pat. Off. .
35470 9/1981 European Pat. Off. ..... 8/107
1372035 10/1974 United Kingdom .

*Primary Examiner*—Christine M. Nucker
*Attorney, Agent, or Firm*—Lynne Darcy; James J. Farrell

[57] ABSTRACT

A photobleach system is disclosed comprising a synergistic mixture of an electron donor and a visible/ultraviolet radiation absorbing compound (a chromophore acceptor) which is capable of, in an excited electronic state, undergoing electron transfer from said electron donor. A composition comprising said photobleach system and use of the system or composition in bleaching dyes and textiles are also disclosed. A preferred electron donor is sodium sulphite. Preferred chromophore acceptors are water-soluble metallated phthalocyanines and naphtalocyanines.

15 Claims, 2 Drawing Figures

PHOTOBLEACH SYSTEM, COMPOSITION AND PROCESS

This invention relates to improved photobleach systems and to compositions comprising said system.

Photobleaches are known in the art. Generally photobleaches exert their bleaching action from the production of a reactive oxidising species through photochemical activation by absorption of visible and/or ultraviolet radiation. Examples of photobleaches are porphine compounds, particularly phthalocyanines and naphthalocyanines, described in the literature as photoactivators, photochemical activators or photosensitizers.

It has now been found that a much more effective photobleach can be obtained by the photochemical generation of reducing bleaches from a visible/ultraviolet radiation absorbing compound which is capable of, in an excited electronic state, undergoing electron transfer from an electron donor present.

The improved photobleach system of the invention comprises a synergistic mixture of an electron donor and a visible/ultraviolet radiation absorbing compound which is capable of, in an excited electronic state, undergoing electron transfer from said electron donor.

Preferred electron donors are those which on transferring its electron will not be capable of undergoing the reverse reaction. Thus, in general "sacrificial" electron donors are usable for the present invention.

Examples of electron donors usable in the present invention are alkali metal sulphites, such as sodium or potassium sulphite ($Na_2SO_3$ or $K_2SO_3$); cysteine; alkali metal thiosulphate, such as sodium or potassium thiosulphate; ferrous sulphate ($FeSO_4$); and stannous chloride ($Sn_2Cl_2$). Preferred electron donors are alkali metal sulphites, particularly sodium sulphite.

Examples of visible/ultraviolet radiation absorbing compounds which can be used in the invention are porphine photoactivator compounds such as phthalocyanines, preferably the water-soluble metallated phthalocyanines such as the sulphonated aluminium or zinc phthalocyanines; and naphthalocyanines such as the sulphonated aluminium or zinc naphthalocyanines.

A typical listing of the classes and species of porphine photoactivator compounds usable in the present invention is given in the European Patent Application Nos. EP 0 003 149 and EP 0 003 371; German Patent Application No. DE 2 812 261; and the U.S. Pat. Nos. 4,166,718 and 4,033,718, which are hereby incorporated herein by reference.

Without wishing to be bound to any theory it is believed that the visible/ultraviolet radiation absorbing compound, hereinafter also referred to as "chromophore acceptor" or simply "acceptor" on absorption of visible and near ultraviolet radiation produces its excited electronic state as shown in the following reaction:

$$\text{chromophore acceptor} + h\nu \rightarrow \text{chromophore acceptor}^* \quad (1)$$

In the presence of a suitable electron donor this excited chromophore acceptor undergoes electron transfer from said electron donor forming a reactive radical anion, which is the bleaching species, as shown in reactions (2) and (3)

$$\text{chromophore acceptor}^* + e \rightarrow \text{acceptor} \quad (2)$$

$$\text{Electron donor} \rightarrow \text{Electron donor}^+ + e \quad (3)$$

Since the produced radical anion is believed to be the bleaching species, the reduction potential for the chromophore acceptor must be as negative as possible. To form these reactive radical anions the electron donor must transfer an electron to the acceptor in its excited electronic state.

The reducing power necessary for the electron donor will obviously depend on the nature of the excited acceptor in question, i.e. on thermodynamic grounds there is an interdependency between the reduction potentials of the donor and the acceptor in its excited state and electron donors with reduction potential E° lower than the reduction potential of reaction (2) will reduce.

Suitable chromophore acceptors are those having a reduction potential E° (acceptor/acceptor $^{\cdot-}$) $\leqq 0.0$ eV., preferably $\leqq -0.4$ eV. and E° (acceptor*/acceptor $^{\cdot-}$) $\leqq 3.0$ eV., preferably $\leqq 0.8$ eV.

Suitable electron donors are those having a reduction potential E° (Donor$^+$/Donor) $< 3.0$ eV., preferably $< 0.8$ eV., Substantially all porphine photoactivators fall under the above definition and will be suitable for use as the chromophore acceptor in the present invention.

From the literature it has been shown that the approximate reduction potentials for the ground and excited state of some typical phthalocyanine photoactivators are as follows:

| | |
|---|---|
| Aluminium phthalocyanine sulphonate (AlPCS) | |
| has E° (AlPCS/AlPCS$^{\cdot-}$) = | −0.65 eV. and |
| E° (AlPCS*/AlPCS$^{\cdot-}$) = | 0.55 eV. |
| Zinc phthalocyanine sulphonate (ZPCS) | |
| has E° (ZPCS/ZPCS$^{\cdot-}$) = | −0.90 eV. and |
| E° (ZPCS*)/ZPCS$^{\cdot-}$) = | 0.30 eV. |
| Cadmium phthalocyanine sulphonate (CdPCS) | |
| has E° (CdPCS/CdPCS$^{\cdot-}$) = | −1.17 eV. and |
| E° (CdPCS*/CdPCS$^{\cdot-}$) = | 0.0 eV. |

The photobleach system of the invention is preferably used in or with a detergent composition, particularly for washing and/or treating fabrics, including fabric softening compositions.

The photobleach system of the invention can be incorporated in solid detergent compositions which may be in the form of bars, powders, flakes or granules, but is also especially suitable for use in liquid detergent compositions both built and unbuilt. Preferably a photobleach system comprising a porphine photoactivator and an alkali metal sulphite is used.

Solid powdered or granular formulations embodying the system/compositions of the invention may be formed by any of the conventional techniques e.g. by slurrying the individual components in water and spray-drying the resultant mixture, or by pan or drum granulation of the components, or by simply dry mixing the individual components.

Liquid detergents embodying the system/compositions of the invention may be formulated as dilute or concentrated aqueous solutions or as emulsions or suspensions. Liquid detergents comprising a photobleach system of the invention may have a pH ranging from 8–11, preferably $< 10$, particularly $< 9$, and should preferably be packed in opaque containers impervious to light.

Accordingly the invention also includes detergent compositions comprising an organic detergent compound, a chromophore acceptor as defined hereinbefore and an electron donor as defined hereinbefore. The chromophore acceptor may be present therein in a proportion of about 0.001 to about 10% by weight of the composition and the electron donor in a proportion of from about 1 to 40% by weight of the composition. Preferred usage of chromophore acceptor in a detergent composition is from 0.001 to 2%, particularly in the lower range of between 0.001 and 0.1% by weight of the composition.

The proportions of organic detergent compound i.e. surfactant, which may be anionic, nonionic, zwitterionic or cationic in nature or mixtures thereof in the compositions of the invention are preferably those conventionally used and may be from about 2 to 60% by weight.

Preferred examples of anionic non-soap surfactants are water-soluble salts of alkyl sulphate, paraffin sulphonate, alpha-olefin sulphonate, alpha-sulfocarboxylates and their esters, alkyl glyceryl ether sulphonate, fatty acid monoglyceride sulphates and sulphonates, alkyl phenol polyethoxy ether sulphate, 2-acyloxyalkane-1-sulphonate, and beta-alkyloxy alkane sulphonate. Soaps are also preferred anionic surfactants.

Especially preferred are alkyl benzene sulphonates with about 9 to about 15 carbon atoms in a linear or branched alkyl chain, more especially about 11 to about 13 carbon atoms; alkyl sulphates with about 8 to about 22 carbon atoms in the alkyl chain, more especially from about 12 to about 18 carbon atoms; alkyl polyethoxy ether sulphates with about, 10 to about 18 carbon atoms in the alkyl chain and an average af about 1 to about 12 —$CH_2CH_2O$—groups per molecule, especially about 10 to about 16 carbon atoms in the alkyl chain and an average of about 1 to about 6 —$CH_2CH_2O$—groups per molecule; linear paraffin sulphonates with about 8 to about 24 carbon atoms, more especially from about 14 to about 18 atoms; and alpha-olefin sulphonates with about 10 to about 24 carbon atoms, more especially about 14 to about 16 carbon atoms; and soaps having from 8 to 24, especially 12 to 18 carbon atoms.

Water-solubility can be achieved by using alkali metal, ammonium, or alkanolamine cations; sodium is preferred. Magnesium and calcium cations may also be used under certain circumstances e.g. as described by Belgian Pat. No. 843,636.

Mixtures of anionic surfactants, such as a mixture comprising alkyl benzene sulphonate having 11 to 13 carbon atoms in the alkyl group and alkyl polyethoxy alcohol sulphonate having 10 to 16 carbon atoms in the alkyl group and an average degree of ethoxylation of 1 to 6, may also be used as desired.

Preferred examples of nonionic surfactants are water-soluble compounds produced by the condensation of ethylene oxide with a hydrophobic compound such as an alcohol, alkyl phenol, polypropoxy glycol, or polypropoxy ethylene diamine.

Especially preferred polyethoxy alcohols are the condensation products of 1 to 30 moles of ethylene oxide with 1 mol of branched or straight chain, primary or secondary aliphatic alcohol having from about 8 to about 22 carbon atoms; more especially 1 to 6 moles of ethylene oxide condensed with 1 mol of straight or branched chain, primary or secondary aliphatic alcohol having from about 10 to about 16 carbon atoms; certain species of polyethoxy alcohol are commercially available under the trade-name "Neodol®", "Synperonic®" and "Tergitol®".

Preferred examples of zwitterionic surfactants are water-soluble derivatives of aliphatic quaternary ammonium, phosphonium and sulphonium cationic compounds in which the aliphatic moieties can be straight or branched, and wherein one of the aliphatic substituents contains from about 8 to 18 carbon atoms and one contains an anionic water-solubilizing group, especially alkyl-dimethylpropane-sulphonates and alkyl-dimethylammonio-hydroxypropane-sulphonates wherein the alkyl group in both types contains from about 1 to 18 carbon atoms.

Preferred examples of cationic surface active agents include the quaternary ammonium compounds, e.g. cetyl trimethyl ammonium bromide or chloride; and distearyldimethyl ammonium chloride; and the fatty alkyl amines, e.g. di-$C_8$–$C_{26}$ alkyl tertiary amines and mono $C_{10}$–$C_{20}$ alkyl amines.

A further typical listing of the classes and species of surfactants useful in this invention appear in the books "Surface Active Agents", Vol. I, by Schwartz & Perry (Interscience 1949) and "Surface Active Agents", Vol. II by Schwartz, Perry and Berch (Interscience 1958), the disclosures of which are incorporated herein by reference. The listing, and the foregoing recitation of specific surfactant compounds and mixtures which can be used in the instant compositions, are representative but are not intended to be limiting.

The compositions may also contain an (alkaline) detergency builder. For example conventional (alkaline) detercency builders, inorganic or organic, can be used at levels up to about 80% by weight of the composition, preferably from 10% to 60%, especially from 20% to 40% by weight.

Examples of suitable inorganic alkaline detergency builders are water-soluble alkalimetal phosphates, polyphosphates, borates, silicates and also carbonates. Specific examples of such salts are sodium and potassium triphosphates, pyrophosphates, orthophosphates, hexametaphosphates, tetraborates, silicates and carbonates.

Examples of suitable organic alkaline detergency builder salts are: (1) water-soluble aminopolycarboxylates, e.g. sodium and potassium ethylenediaminetetraacetates, nitrilotriacetates and N-(2-hydroxyethyl)-nitrilodiacetates; (2) water-soluble salts of phytic acid, e.g. sodium and potassium phytates (see U.S. Pat. No. 2,379,942); (3) water-soluble polyphosphonates, including specifically, sodium, potassium and lithium salts of ethane-1-hydroxy-1,1-diphosphonic acid; sodium, potassium and lithium salts of methylene diphosphonic acid; and sodium, potassium and lithium salts of ethane-1,1,2-triphosphonic acid. Other examples include the alkali metal salts of ethane-3-carboxy-1,1-diphosphonic acid, hydroxymethanediphosphonic acid, carboxyldiphosphonic acid, ethane-1-hydroxy-1,1,2-triphosphonic acid, ethane-2-hydroxy-1,1,2-triphosphonic acid, propane-1,1,3,3-tetraphosphonic acid, propane-1,1,2,3-tetraphosphonic acid, and propane-1,2,2,3-tetraphosphonic acid; (4) water-soluble salts of polycarboxylate polymers and copolymers as described in U.S. Pat. No. 3,308,067.

In addition, polycarboxylate builders can be used satisfactorily, including water-soluble salts of mellitic acid, citric acid, and carboxymethyloxysuccinic acid and salts of polymers of itaconic acid and maleic acid.

Certain zeolites or aluminosilicates can also be used. One such aluminosilicate which is useful in the compositions of the invention is an amorphous water-insoluble hydrated compound of the formula $Na_x(xAlO_2.SiO_2)$, wherein x is a number from 1.0 to 1.2 said amorphous material being further characterized by a $Mg^{++}$ exchange capacity from about 50 mg eq. $CaCO_3$/g. to about 150 mg eq. $CaCO_3$/g. and a particle diameter of from about 0.01 micron to about 5 microns. This ion exchange builder is is more fully described in British Pat. No. 1,470,250.

A second water-insoluble synthetic aluminosilicate ion exchange material useful herein is crystalline in nature and has the formula $Na_z[(AlO_2)_z.(SiO_2)_y]xH]_x.H_2O$, wherein z and y are integers of at least 6; the molar ratio of z to y is in the range from 1.0 to about 0.5, and x is an integer from about 15 about 264; said aluminosilicate ion exchange material having a particle size diameter from about 0.1 micron to about 100 microns; a calcium ion exchange capacity on an anhydrous basis of at least about 200 milligrams equivalent of $CaCO_3$ hardness per gram; and a calcium ion exchange rate on an anhydrous basis of at least about 2 grains/gallon/minute/gram. These synthetic aluminosilicates are more fully described in British Pat. No. 1,429,143.

Further other adjuvants commonly used in detergent compostions such as soil-suspending agents, for example sodium carboxymethylcellulose; optical brightening agents; lather control agents; dyes; perfumes; enzymes, particularly proteolytic enzymes and/or amylolytic enzymes; and germicides may also be included.

The photobleach system and compositions of the invention can be suitably used for bleaching or if an organic detergent compound is present for washing and bleaching of textiles. The bleaching or washing/bleaching or fabric treatment and bleaching process can be suitably carried out out of doors in natural sunlight, as is customary in many countries with sunny climates, or it may be carried out in a washing or laundry machine which is equipped with means for illuminating the contents of the tub during the washing operation.

During the bleaching process, the substrate or the bleach liquor must be irradiated with radiation capable of absorption by the chromophore/acceptor which can range from the near ultra-violet (i.e. ~250 nm) through the visible spectrum to the near infra red (i.e. ~900 nm). When conventional phthalocyanine photobleach compounds are employed as the chromophore/acceptor this radiation must include light of wavelength 600–700 nm. Suitable sources of light are sunlight, normal daylight or light from an incandescent or fluorescent electric lamp bulb. The intensity of illumination required depends on the duration of the treatment and may vary from the normal domestic lighting in the case of several hours soaking, to the intensity obtained from an electric light mounted within a short distance of the surface of the treatment bath in a bleaching and/or washing process.

The concentration of chromophore acceptor in the washing and/or bleaching solutions can be from 0.02 to 500 parts per million, preferably from 0.1 to 125 ppm, particularly from 0.25 to 50 ppm.

The concentration of electron donor required in the washing and/or bleaching solution should be at least $3\times10^{-5}$M, preferably $\geqq 5\times10^{-4}$M and particularly within the range of between $5\times10^{-3}$M and $2\times10^{-2}$M.

The invention will now be further explained and illustrated using AlPCS as chromophore acceptor.

EXAMPLE 1

Figure 1:
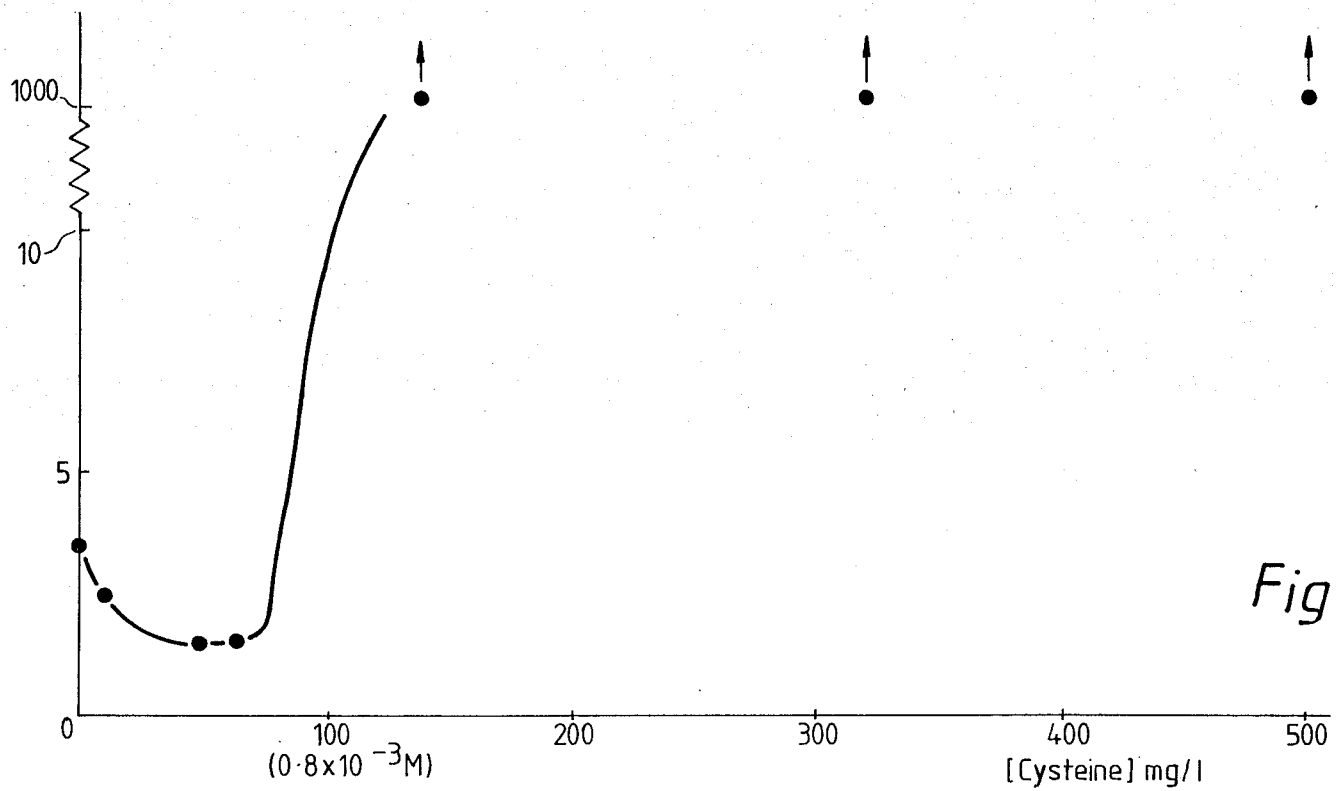
FIG. 1 shows a plot of the photobleaching of a direct red dye Direct Fast Red 5B (DR81) in alkaline aqueous solution, buffered with sodium triphosphate to pH 9.8, by AlPCS as a function of cysteine concentration.

The photobleaching of a direct red dye Direct Fast Red 5B (DR81) in alkaline aqueous solution, buffered with sodium triphosphate to pH 9.8, by AlPCS was studied as a function of cysteine concentration. The results are shown in FIG. 1. As can be seen from this figure, increase of the cysteine concentration in solution from 0 to about $10^{-3}$M resulted in no enhancement of photobleaching; on the contrary the photobleaching action of AlPCS is quenched at these concentrations of cysteine. Further addition of cysteine ($>10^{-3}$M) resulted in the very large enhancements in photobleaching efficiency.

If the atmosphere of oxygen is replaced by $N_2$ in the AlPCS/cysteine solution system where the concentration of cysteine $<10^{-3}$M, large enhancement in photobleaching efficiency is observed, for example under nitrogen 60 mg/l cysteine produces a relative DR81 bleaching response of over 1000 (see FIG. 1).

These observations allow to postulate the complete photochemical sequence of reactions resulting in these photobleaching effects as shown in the following table 1.

TABLE 1

| | |
|---|---|
| (A) | $AlPCS + h\nu\ {}^1AlPCS^* \rightarrow {}^3AlPCS^*$ |
| | $({}^3AlPCS^* + O_2 \rightarrow {}^1O_2^* + AlPCS$ |
| (B) | $({}^3AlPCS^* \rightarrow$ photodecomposition |
| | $({}^3AlPCS^* + \text{cysteine})AlPCS^{\overline{\cdot}} + \text{cysteine}^+)$ |
| (C) | $2(AlPCS \ldots \text{cysteine}^+) \rightarrow 2AlPCS^{\overline{\cdot}} + \text{cystine} + 2H^+$ |
| (D) | ${}^1O_2^* + \text{cysteine} \rightarrow$ cysteine oxidation |
| (E) | $(AlPCS^{\overline{\cdot}} + DR81 \rightarrow AlPCS + DR81^{\overline{\cdot}}$ |
| | $(DR81^{\overline{\cdot}} \rightarrow$ bleaching |

(A) AlPCS absorbs solar radiation to produce its excited triplet electronic state ${}^3AlPCS^*$.

(B) Reaction of ${}^3AlPCS^*$ either unimolecularly or with oxygen or cysteine. (The competition between cysteine and oxygen for the ${}^3AlPCS^*$ results in the enhanced photobleaching effects observed under $N_2$ and for the lack of photobleaching enhancement at low cysteine concentrations.)

(C) Formation of separated $AlPCS^{\overline{\cdot}}$ radical anion.

(D) Reaction of cysteine with the singlet oxygen produced. (The reaction only occurs to any extent at low concentrations of cysteine. In this regime oxygen wins the competition for ${}^3AlPCS^*$ quenching over cysteine and singlet oxygen is produced. The cysteine $+ {}^1O_2^*$ reaction results in a loss of photobleaching efficiency at low cysteine concentrations.)

(E) Bleaching of the stain chromophore (DR81) by $AlPCS^{\overline{\cdot}}$. (AlPCS in the presence of electron donors conclusively form AlPCS radical anion. It would appear to a high degree of certainty that $AlPCS^{\overline{\cdot}}$ is the bleaching species. The improved bleaching reaction has been postulated as being a consequence of electron transfer from the $AlPCS^-$ moiety to the stain chromophore DR81, as opposed to the situation of AlPCS in the absence of electron donors where excited singlet oxygen is the principal bleaching species.

EXAMPLE 2

The photobleaching effectiveness of AlPCS in the presence and absence of $SO_3^{2-}$($Na_2SO_3$) was investigated in aqueous solutions buffered with 1 g/l sodium triphosphate using simulated solar radiation. $Na_2SO_3$ was used at 1 g/l.

The bleaching of Direct Fast Red 5B (DR81) in solution was monitored and shown in table 2.

TABLE 2

| System | Treatment | Relative DR81 bleaching effect | Relative Rate of loss of AlPCS |
|---|---|---|---|
| $Na_2SO_3$ | 30 min dark | ~0 | — |
| $Na_2SO_3$ | 30 min irradiation | ~0 | — |

TABLE 2-continued

| System | Treatment | Relative DR81 bleaching effect | Relative Rate of loss of AlPCS |
|---|---|---|---|
| AlPCS | 30 min irradiation | 12 | 7 |
| AlPCS/$Na_2SO_3$ | 30 min irradiation | 31 | 1.8 |

From the above table it is clear that the AlPCS/$Na_2SO_3$ combination is far superior to AlPCS alone and that the presence of $SO_3^{2-}$ greatly reduces the concurrent AlPCS selfphotodecomposition reaction.

EXAMPLES 3(i)-3(iv)

(1) Photobleaching of DR81 in aqueous solution

DR81 (initial optical density OD=0.45) in aqueous solutions buffered to pH 9.8 with 1.0 g/l sodium triphosphate in the presence of AlPCS (initial optical density OD=0.45) and sodium sulphite at various concentrations. The solutions were exposed to simulated solar radiation (filtered 6 KW Xenon lamp radiation) in pyrex cells of 0.7 cm path length at about 30° C.

The results are shown in table 3 below:

TABLE 3

| | $[SO_3^=]$ | | | |
|---|---|---|---|---|
| | 0 g/l | 0.1 g/l [7.93 × $10^{-4}$ M] | 0.5 g/l [3.97 × $10^{-3}$ M] | 1 g/l [7.93 × $10^{-3}$ M] |
| % DR81 loss after 5 mins | 3.3 | 3.3 | 48 | 67 |
| % AlPCS loss after 5 mins | 3.5 | 3.8 | 1.3 | 1.1 |

It can be readily seen that the presence of ≧0.5 g/l of sodium sulphite greatly enhances the photobleaching capabilities of AlPCS (~x20). As the photobleaching of DR81 in the presence of $Na_2SO_3$ alone is neglibible, the AlPCS/$SO_3^=$ mixture is clearly synergistic. The presence of $SO_3^=$ clearly renders the AlPCS more photostable.

(ii) Photobleaching of DR80 in aqueous solution

Performed in a similar manner to that above it was shown that in terms of photobleaching efficiency $$AlPCS/SO_3^= = 75 \times AlPCS$$

The dye DR80 is completely photostable in the presence of $Na_2SO_3$ alone and the mixture is thus again highly synergistic.

Again, in a similar manner to that found above, the presence of sulphite results in a ~3 fold improvement in the photostability of AlPCS.

(iii) Photobleaching of Other Direct Dyes in aqueous solution

Performed in a similar manner to that above it was shown that Congo Red (initial O.D=0.4) is bleached ~100 times faster by AlPCS in the presence of 1 g/l $Na_2SO_3$ than with AlPCS alone.

Synergistic photobleaching effects in solution for the $Na_2SO_3$/AlPCS mixture have also been observed for the bleaching of benzopurpurine and other dyes.

(iv) Photobleaching of DR81 in aqueous solution using various electron donors

Figure 2:
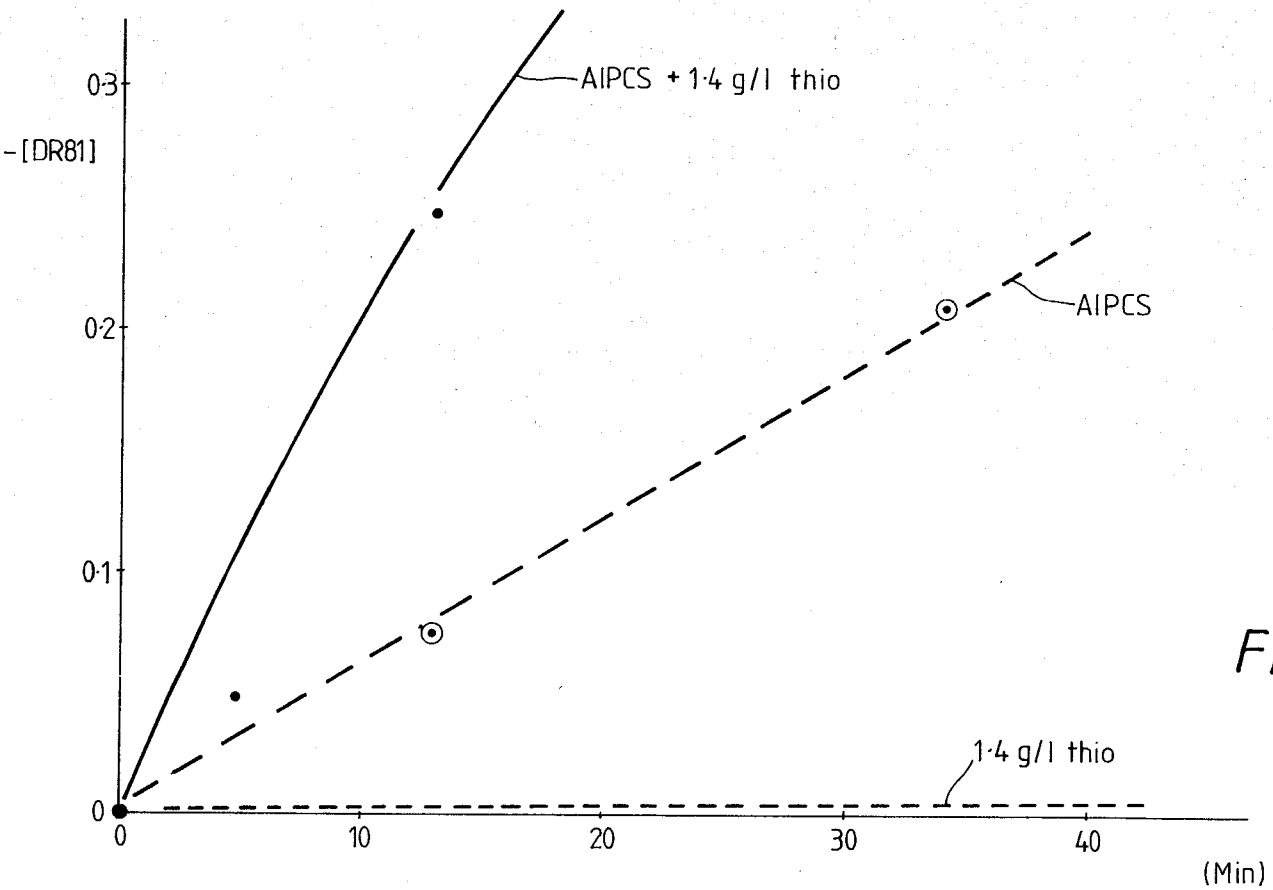
FIG. 2 shows a plot of the reduction in DR81 concentration against radiation time for thiosulphate alone, AlPCS alone and AlCPS/thiosulphate.

| | |
|---|---|
| (a) Cysteine | see above. |
| (b) Thiosulphate | performed in a similar method to (i)-(iii) above, at [thiosulphate] = 1.4 g/l = 5.7 × $10^{-3}$ M the synergistic effects as described graphically in FIG. 2 were observed. |

In FIG. 2 the reduction in DR81 concentration is set out against radiation time for thiosulphate alone, AlPCS alone and ALPCS/thiosulphate. The enhancement achieved with the ALPCS/thiosulphate system is evident.

Similar synergistic effects were observed with the following electron donating systems:

| | |
|---|---|
| (c) Ferrous sulphate | performed in a similar method to (i)-(iii) above, at [$FeSO_4$] = 0.6 g/l = 3.97 × $10^{-3}$ M. |
| (d) Stannous chloride ($Sn_2Cl_2$) | performed in a similar method to (i)-(iii) above, at [$SnCl_2$] = 0.6 g/l = 3.16 × $10^{-3}$ M. |

EXAMPLE 4

Photobleaching of Red-Wine Stained Cotton (EMPA-114) using AlPCS/$SO_3^=$

Pre-washed EMPA 114 clothes were soaked in sodium triphosphate (STP) buffered solutions of AlPCS. The fabrics were then irradiated for 90 minutes with simulated solar radiation. During this irradiation the clothes were rewetted with either $Na_2SO_3$ solution (0.5, 1.0 and 2.0 g/l) or STP solution of identical pH every 30 minutes. The monitors were rinsed, dried and the bleaching obtained measured by monitoring the change of reflectance at 460 nm ($\Delta R_{460}$). Various levels of adsorbed AlPCS were investigated, but as an example one such level achieved by a 20 min soak has been selected to show the synergistic effects possible.

In the absence of AlPCS there is no difference in the photobleaching observed when the fabrics are rewetted with 2 g/l $Na_2SO_3$ or with STP solution of identical pH. Thus the differences in $\Delta R_{460}$,$\Delta\Delta R_{460}$, depict the synergistic effect $Na_2SO_3$ has on the AlPCS induced photobleaching of EMPA 114 red wine stain (Table 4).

TABLE 4

| Rewet System | $\Delta^R460$ | $\Delta\Delta^R460$ | $\Delta^R460$ | Rewet System |
|---|---|---|---|---|
| $Na_2SO_3$ (2 g/l) | 13.9 | 4.2 | 9.7 | STP pH 9.12 |
| $Na_2SO_3$ (1 g/l) | 14.3 | 5.0 | 9.3 | STP pH 8.97 |
| $Na_2SO_3$ (0.5 g/l) | 12.1 | 3.7 | 8.4 | STP pH 8.6 |

EXAMPLES 5-6

These examples illustrate some liquid detergent compositions comprising a photobleach system of the invention:

| | % by weight |
|---|---|
| Unbuilt liquid detergent composition (5) | |
| Ethoxylated coconut alcohol (7 EO*) | 30.0 |
| Triethanolamine | 10.0 |
| Dodecylbenzenesulphonic acid | 10.0 |
| Ethanol | 5.0 |

-continued

| | % by weight |
|---|---|
| Sodium sulphite | 5.0 |
| AlPCS** | 0.01 |
| Fluorescent agent | 0.01 |
| Water up to 100%. | |
| Built liquid detergent composition (6) | |
| Sodium dodocylbenzenesulphate | 6.0 |
| $C_{8-12}$ alcohol/7 EO* condensate | 2.0 |
| Coconut diethanolamide | 1.3 |
| Sodium oleate | 1.6 |
| Sodium triphosphate | 25.0 |
| Sodium carboxymethylcellulose | 0.1 |
| Fluorescent agent | 0.1 |
| Borax ($5H_2O$) | 4.5 |
| Glycerol | 3.0 |
| Proteolytic enzyme (9 GU/mg) | |
| AlPCS** | 0.0075 |
| Sodium sulphite | 4.5 |
| Water up to 100%. | |

*EO = ethylene oxide.
**AlPCS = aluminium phthalocyanine-tetrasulphonic acid (Na Salt).

EXAMPLE 7

Photobleaching of DR81 in aqueous solution using zinc phthalocyanine sulphonate (ZPCS).

DR81 (initial optical density=0.19) in aqueous solution buffered to pH 9.8 with 1.0 g/l sodium triphosphate in the presence of ZPCS (initial optical density=0.135) with and without sodium sulphite was exposed to simulated solar radiation as described in Example 3.

The results are shown in Table 5.

TABLE 5

| | $Na_2SO_3$ | |
|---|---|---|
| | 0 g/l | 1 g/l |
| % DR81 loss | 5.0 (after 5 min) 15.0 (after 15 min) | 45.0 (after 5 min) 97.0 (after 15 min) |
| % ZPCS loss after 15 min | 15 | <4 |

As can be clearly seen from the above table, the presence of 1 g/l sodium sulphite improves the photobleaching efficiency of ZPCS 6–10 times.

The presence of sodium sulphite also prevents the photodecomposition of ZPCS.

EXAMPLE 8

Photobleaching of DR81 in aqueous solution using proflavine (chromophore acceptor).

DR81 (initial optical density=0.45) in aqueous solution buffered to pH 9.8 with 1.0 g/l sodium triphosphate in the presence of proflavine (11.75 g/l) with and without sodium sulphite was exposed to simulated solar radiation as described in Example 3.

The results are shown in Table 6.

TABLE 6

| | $Na_2SO_3$ | |
|---|---|---|
| | 0 g/l | 1 g/l |
| % DR81 loss after 6 minutes | 0 | 100 |

It can be seen from this table that in the absence of sodium sulphite proflavine does not induce photobleaching. In the presence of 1 g/l sodium sulphite, photobleaching is extremely rapid.

We claim:

1. A photobleach system comprising a synergistic mixture of (a) an electron donor which on transferring its electron will not be capable of undergoing the reverse reaction, having a reduction potential E° (donor+/donor) <3.0 eV, and (b) a visible/ultra-violet radiation absorbing compound (chromophore acceptor) which on absorption of said radiation is converted to its excited electronic state (chromophore acceptor*) which on electron transfer from said electron donor forms a reactive radical anion (chromophore acceptor$^{\overline{\cdot}}$), said chromophore acceptor having a reduction potential (acceptor/acceptor$^{\overline{\cdot}}$)≦0.0 eV and E° (acceptor*/acceptor$^{\overline{\cdot}}$)≦3.0 eV, the E° (donor+/donor) being lower than the E° (acceptor*/acceptor$^{\overline{\cdot}}$).

2. A photobleach system according to claim 1, wherein E° (acceptor*/acceptor$^{\overline{\cdot}}$)≦−0.4 eV, E° (acceptor*/acceptor$^{\overline{\cdot}}$)≦0.8 eV and E° (donor+/donor-)<0.8 eV.

3. A photobleach system according to claim 1, in which the electron donor is an alkalimetal sulphite.

4. A photobleach system according to claim 3, in which the electron donor is sodium sulphite.

5. A photobleach system according to claim 1, in which the chromophore acceptor is a porphine photoactivator compound.

6. A photobleach system according to claim 5, in which the porphine photoactivator compound is selected from the group consisting of water-soluble metallated phthalocyanines and water-soluble metallated naphthalocyanines.

7. A photobleach composition comprising 2 to 60% by weight of an organic detergent compound, 0.001 to about 10% by weight of a chromophore acceptor having a reduction potential E° (acceptor/acceptor$^{\overline{\cdot}}$)≦0.0 eV and E° (acceptor*/acceptor$^{\overline{\cdot}}$)≦3.0 eV, and 1 to about 40% by weight of an electron donor, which on transferring its electron will not be capable of undergoing the reverse reaction and having a reduction potential E° (donor+/donor)<3.0 eV, the E° (donor+/donor) being lower than E° (acceptor*/acceptor$^{\overline{\cdot}}$).

8. A composition according to claim 7, wherein said chromophore acceptor is a porphine photo-activator and said electron donor is sodium sulphite.

9. A composition according to claim 7, which comprises 0.001 to 2% by weight of the chromophore acceptor.

10. A composition according to claim 7, which further comprises a detergency builder in an amount up to 80% by weight.

11. A composition according to claim 7, which is a liquid detergent composition having a pH of from 8 to 11.

12. A composition according to claim 11, in which the pH is from 8 to 9.

13. A process for bleaching substrates or liquids, comprising the steps of contacting said substrates or liquids with a bleaching solution comprising 0.02 to 500 parts per million of a chromophore acceptor and at least $3\times10^{-5}$ of an electron donor, irradiating said substrate or bleach liquor with a radiation capable of absorption by the chromophore acceptor ranger from near ultraviolet of a wavelength of about 250 nm through the visible spectrum to near infra-red of a wavelength of about 900 nm, wherein said electron donor has a reduction potential E° (donor+/donor)<3.0 eV, and on transferring its electron will not be capable of undergoing the reverse reaction; and wherein said chromophore acceptor is a visible/ultra-violet radiation absorbing compound which on absorption of said radiation is converted to its excited electronic state (chromophore acceptor*) which on electron transfer from said electron donor forms a reactive radical anion (chromophore acceptor$^{\overline{\cdot}}$), said chromophore acceptor having a reduction potential E° (acceptor/acceptor$^{\overline{\cdot}}$)$\leqq$0.0 eV and E° (acceptor*/acceptor$^{\overline{\cdot}}$) $\leqq$3.0 eV; and wherein the E° (donor$^{+}$/donor) is lower than the E° (acceptor*-/acceptor$^{\overline{\cdot}}$).

14. A process according to claim 13, in which the radiation includes light having a wavelength of from 600 to 700 nm.

15. A process according to claim 13, wherein said chromophore acceptor is a porphine photo-activator and said electron donor is sodium sulphite.

* * * * *